US008025287B2

(12) United States Patent
Okamoto

(10) Patent No.: US 8,025,287 B2
(45) Date of Patent: Sep. 27, 2011

(54) SHEET MATERIAL FEEDING APPARATUS AND IMAGE FORMING APPARATUS

(75) Inventor: Takayuki Okamoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/950,295

(22) Filed: Nov. 19, 2010

(65) Prior Publication Data

US 2011/0133393 A1 Jun. 9, 2011

(30) Foreign Application Priority Data

Dec. 3, 2009 (JP) ..... 2009-275551

(51) Int. Cl.
*B65H 1/00* (2006.01)

(52) U.S. Cl. ..... 271/171; 271/127; 271/162

(58) Field of Classification Search ..... 271/171, 271/127, 162, 167
See application file for complete search history.

(56) References Cited

U.S. PATENT DOCUMENTS 7,134,657 B2 * 11/2006 Yanagi et al. ..... 271/171
7,770,888 B2 * 8/2010 Nakamura ..... 271/171
7,845,632 B2 * 12/2010 Windsor et al. ..... 271/171
2003/0151188 A1 * 8/2003 Imahara ..... 271/171
2010/0270734 A1 * 10/2010 Bridges et al. ..... 271/147
2010/0270735 A1 * 10/2010 Allwright et al. ..... 271/171

FOREIGN PATENT DOCUMENTS

JP 2004-075356 3/2004

* cited by examiner

*Primary Examiner* — Kaitlin Joerger

(74) *Attorney, Agent, or Firm* — Fitzpatrick, Cella, Harper & Scinto

(57) ABSTRACT

The sheet material feeding apparatus according to this invention comprises a sheet material stacking unit selectively located at a feeding position for feeding a sheet material and at a standby position for non-feeding a sheet material; a first holding force applying unit configured to apply a first holding force and a second holding force applying unit configured to apply a second holding force for holding the guide member to the sheet material stacking unit; and a restraining unit configured to restrain the second holding force applying unit from applying the second holding force when the sheet material stacking unit is in the standby position.

6 Claims, 8 Drawing Sheets

SHEET MATERIAL FEEDING APPARATUS AND IMAGE FORMING APPARATUS

BACKGROUND OF THE INVENTION

1. Field of the Invention

The present invention relates to a sheet material feeding apparatus which can be applied to image forming apparatuses, such as printers, copying machines and facsimiles, and to an image forming apparatus having the sheet material feeding apparatus.

2. Description of the Related Art

Existing image forming apparatuses or printing apparatuses, such as printers, copying machines and facsimiles, have been using as print medium sheet materials that include plain papers, thick papers such as postcards and envelopes, and special sheet materials such as plastic thin plates. Feeding sheet materials to such apparatuses is performed either manually one sheet at a time or automatically and/or continuously by a sheet material feeding apparatus.

The sheet material feeding apparatus comprises, for example, a pressure plate on which to stack a sheet material, a feeding roller to feed the sheet material from the pressure plate, and a movable guide member to regulate the position and direction of the sheet material mounted on the pressure plate. The pressure plate is normally located at a standby position from which the sheet material is not fed. To feed the sheet material, the pressure plate is moved to a feeding position where it engages the feeding roller.

An example of such a sheet material feeding apparatus is disclosed in Japanese Patent Laid-Open No. 2004-075356. In the sheet material feeding apparatus of Japanese Patent Laid-Open No. 2004-075356, a roulette unit is provided on a sheet material stacking surface of the pressure plate and a roulette engagement unit adapted to engage the roulette unit is provided on a slide surface of the guide member. With these units engaged, the guide member is held at a position corresponding to the size of the sheet material. These units are disengaged by an operator pushing an operation unit on the guide member, allowing the guide member to be moved.

In the sheet material feeding apparatus described above, it is desired that the guide member be made operable with optimal force, e.g. small force, when moving the guide member relative to the pressure plate to a position that matches the size of the sheet material. When the guide member has been moved to a desired position, it is also desired that an optimal holding force be applied between the guide member and the pressure plate to hold the guide member at that position. In feeding a sheet material, it is further desired that the guide member be firmly held to the pressure plate so that it will not be moved by the sheet material feeding operation.

SUMMARY OF THE INVENTION

The present invention has been accomplished under the aforementioned circumstances and its objective is to make it possible to, when not feeding the sheet material, move the guide member relative to the pressure plate with an optimal operation force and, when feeding the sheet material, firmly hold the guide member to the pressure plate.

This invention provides a sheet material feeding apparatus comprising: a sheet material stacking unit located selectively at a feeding position for feeding a sheet material and at a standby position for non-feeding a sheet material and on which one or more sheet materials are stacked, a guide member mounted to the sheet material stacking unit to restrict the position and direction of the sheet material, the guide member being slidable on the sheet material stacking unit in a direction perpendicular to a sheet material feeding direction, a first holding force applying unit configured to apply a first holding force for holding the guide member to the sheet material stacking unit, a second holding force applying unit configured to apply a second holding force for holding the guide member to the sheet material stacking unit, and a restraining unit configured to restrain the second holding force applying unit from applying the second holding force when the sheet material stacking unit is in the standby position.

According to the invention, when the sheet material stacking unit is in the standby position, the first holding force can be applied to hold the guide member to the sheet material stacking unit, and when the sheet material stacking unit is in the feeding position, the first holding force and the second holding force can be applied to hold the guide member to the sheet material stacking unit. This enables the guide member to be moved relative to the sheet material stacking unit with an optimal operation force when the sheet material is not fed, and when the sheet material is fed, enables the guide member to be firmly held to the sheet material stacking unit.

Further features of the present invention will become apparent from the following description of exemplary embodiments with reference to the attached drawings.

DESCRIPTION OF THE EMBODIMENTS

Now, one embodiment according to the invention will be described. First, the outline construction of an inkjet printing apparatus (hereinafter referred to simply as a printing apparatus) 10 of image forming apparatuses, applying the sheet material feeding apparatus as one embodiment of this invention, is explained.

The printing apparatus 10 comprises a feeding unit 12, that constitutes the sheet material feeding apparatus as one embodiment of this invention, a conveying unit, a carriage unit and a discharging unit. A sheet material P is placed on the feeding unit, from which it is fed to a conveying unit. An image (including a letter and a line) is formed by the carriage unit in the sheet material P, as it is conveyed by the conveying unit. After having formed the image, the sheet material P with the image is discharged by the discharging unit. The operations of these constitutional elements are controlled by a control unit or controller. The printing apparatus 10 of this construction ejects ink at desired timings onto the sheet material P to form desired image on it. The sheet material P may include a variety of mediums, such as a paper, a plastic material and a film.

The feeding unit 12 is constructed so that it can separate the sheet materials P one by one and feed the separated sheet material P to the conveying unit. The detail of the feeding unit will be explained later. The conveying unit has a conveying roller to convey the sheet material P, pinch rollers driven by the conveying roller, and a PE sensor to detect the end of the sheet material. The pinch rollers are urged by springs to come into pressured contact with the conveying roller to produce a sheet material conveying force. The carriage unit constituting a printing unit has a carriage and a print head mounted on the carriage. The carriage is supported by a guide shaft mounted to a chassis to reciprocally move the carriage in a direction perpendicular to the sheet material conveying direction, and by a guide rail that holds the carriage in order to maintain a gap between the print head and the sheet material P. The print head is an inkjet print head attached with a replaceable ink tank. The ink ejection by this print head for printing consists in energizing electrothermal conversion members or heaters according to a print signal to produce a film boiling in ink and causing bubbles formed in ink to eject ink from nozzles as the bubbles expand and contract in ink. The discharging unit has a discharge roller.

Figure 1:
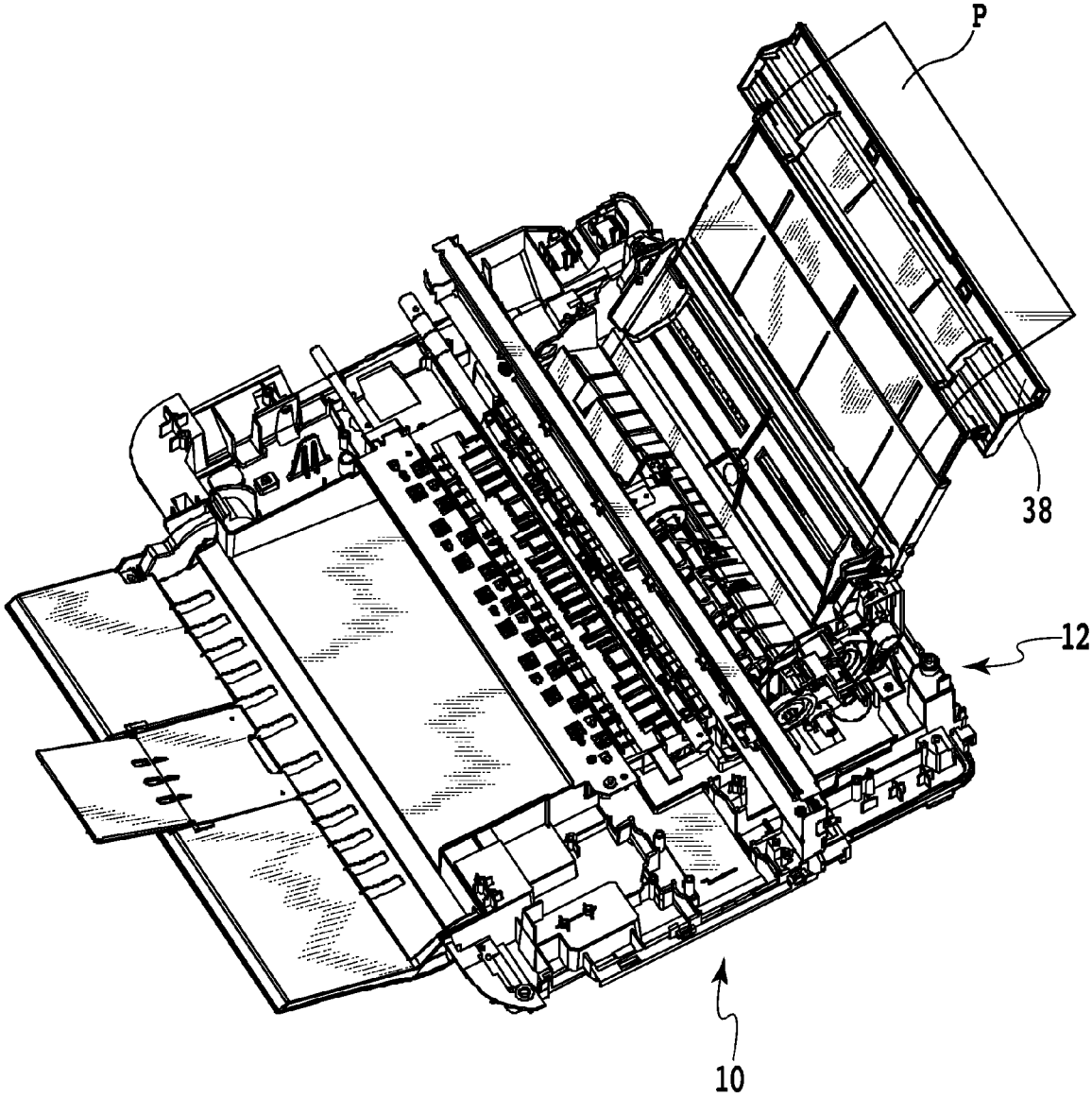
FIG. 1 is a perspective view showing a part of a printing apparatus to which one embodiment according to the present invention is applied.
Figure 2:
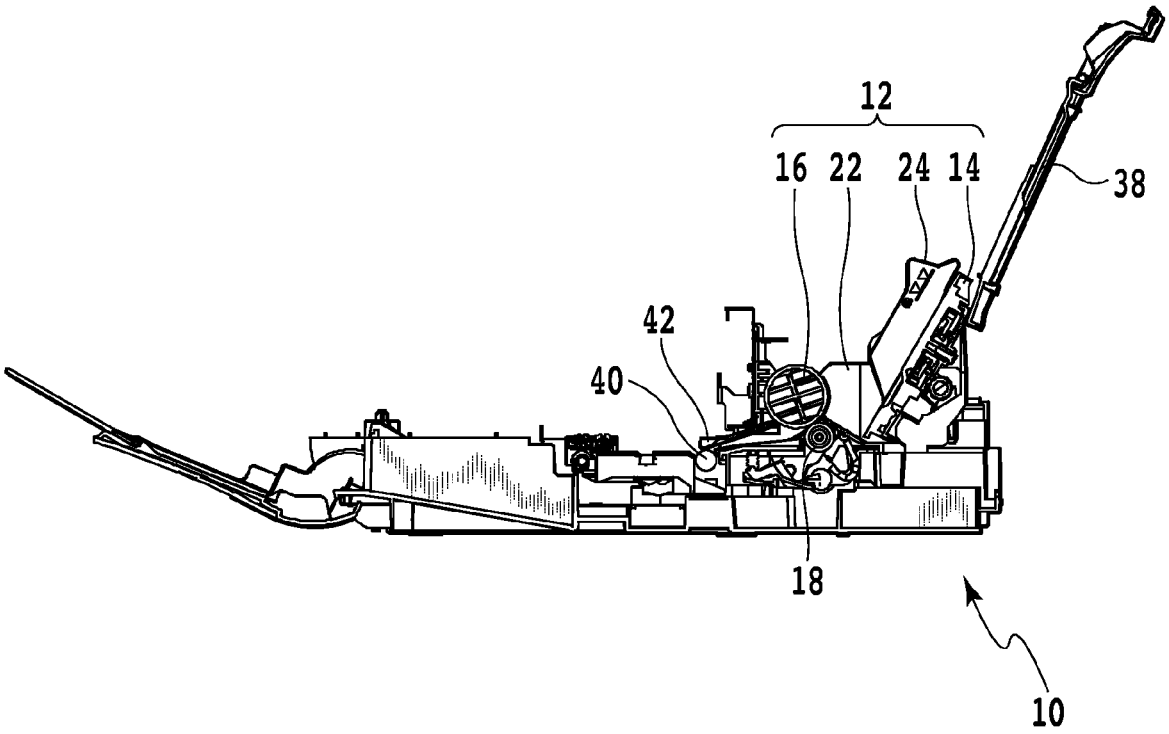
FIG. 2 is a side cross-sectional view showing a part of the printing apparatus of FIG. 1.
Figure 3:
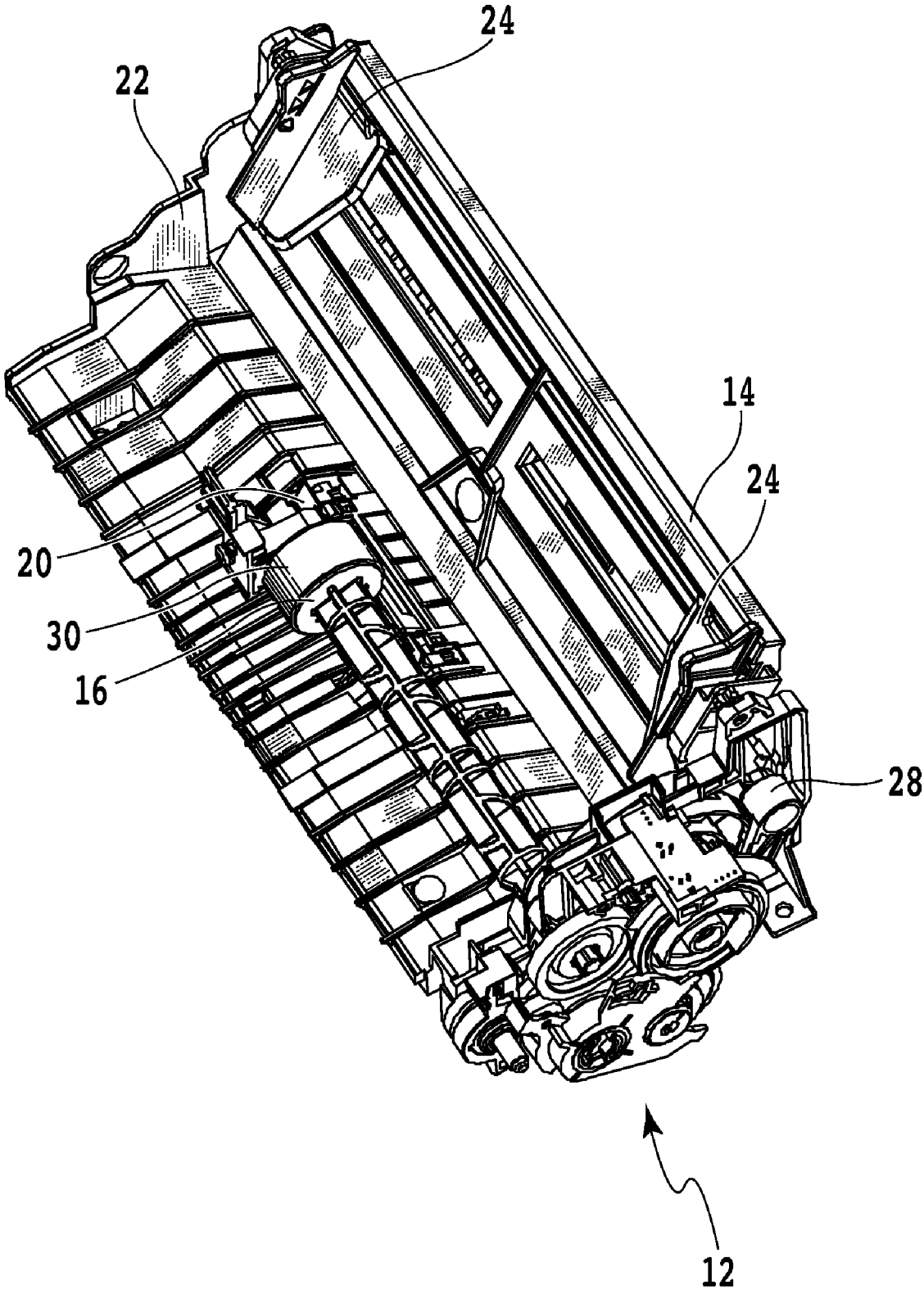
FIG. 3 is a perspective view showing a feeding unit of the printing apparatus of FIG. 1, the feeding unit representing a sheet material feeding apparatus as one embodiment according to the present invention.

Next, the feeding unit 12, that represents the sheet material feeding apparatus as one embodiment of this invention, will be explained by referring to the drawings. FIG. 1 and FIG. 2 show a part of the printing apparatus 10 with its enclosure, carriage and others removed. In FIG. 1 the sheet material P is shown to be transparent.

The feeding unit 12 has a pressure plate 14, a feeding roller 16, a separation roller 18 and a return lever 20, all mounted on a feeder base 22. The feeding unit 12 also has guide members 24. The guide members 24 are mounted slidable against the pressure plate 14 so that it can restrict the stacking position and direction of the sheet material P on the pressure plate 14. This guide members 24 will be described later.

Figure 4:
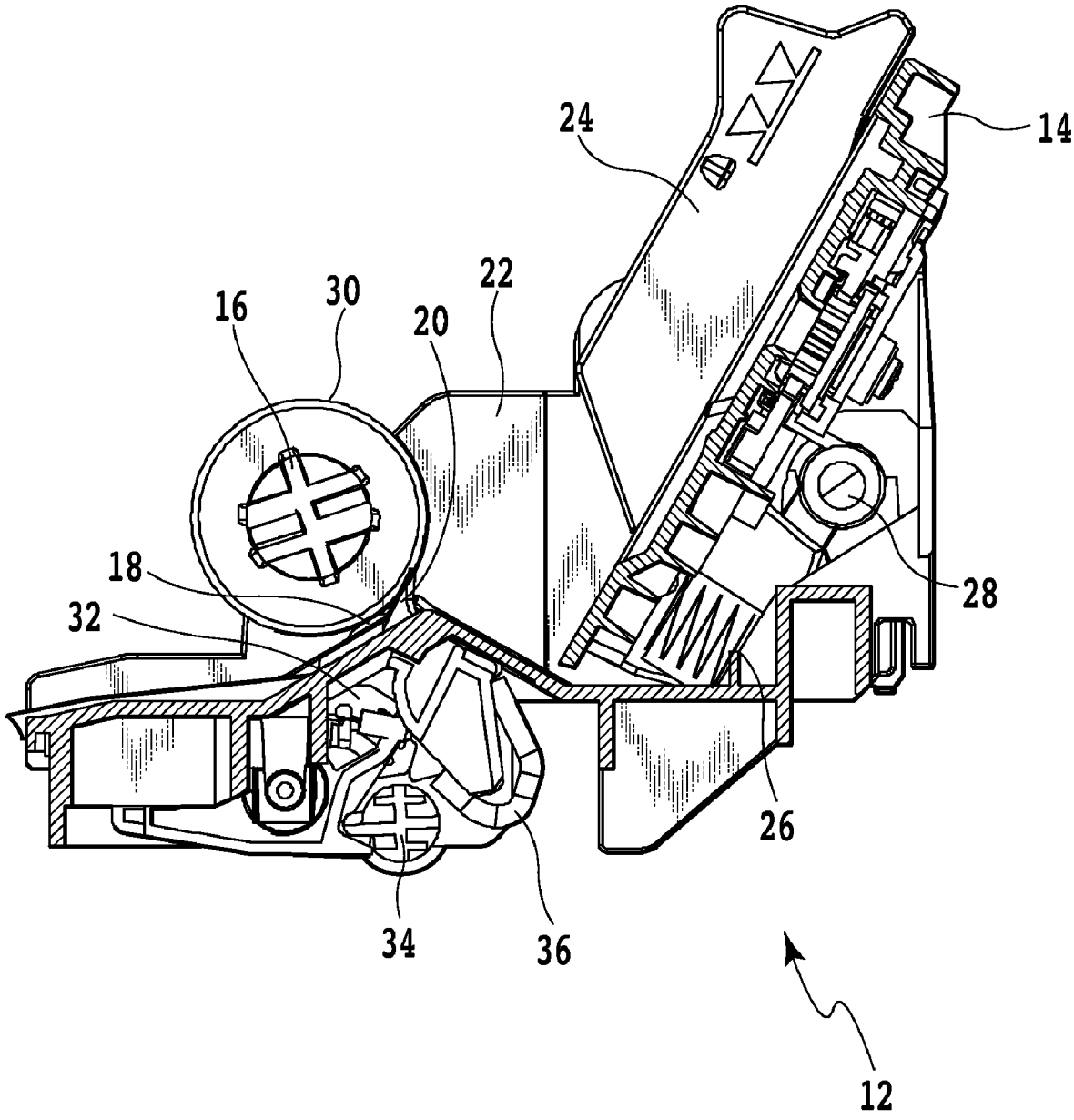
FIG. 4 is a side cross-sectional view of the feeding unit of FIG. 3.
Figure 5:
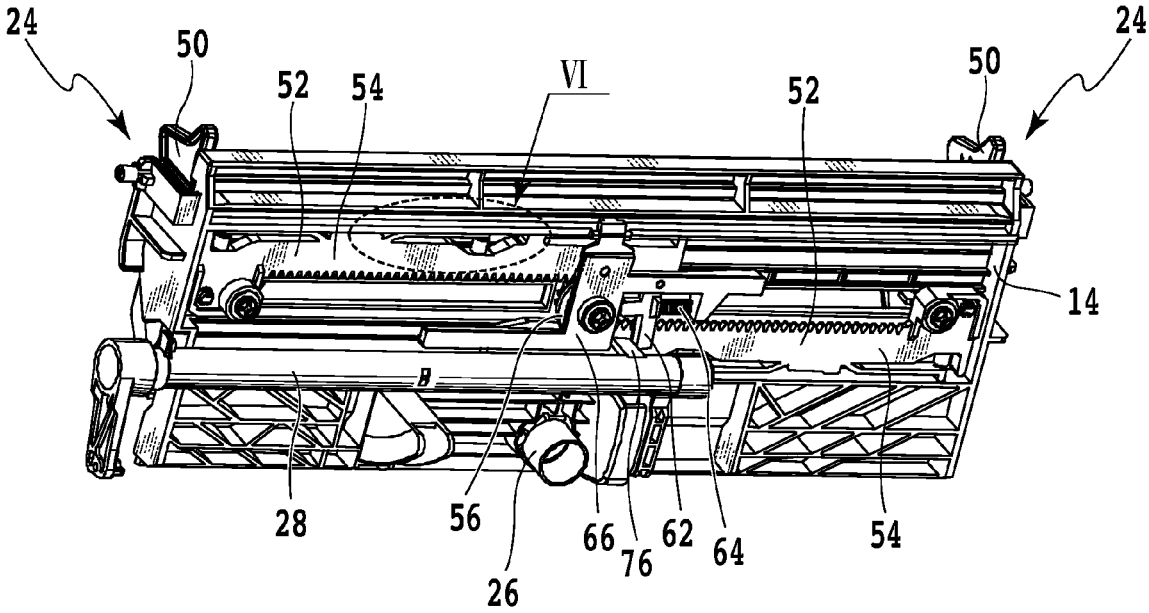
FIG. 5 is a back perspective view of the feeding unit and its surrounding portions, showing a moving mechanism and a holding mechanism for the guide member in the feeding unit of FIG. 3.

The pressure plate 14 is provided to stack a sheet material P on it, on which one or a plurality of sheet materials P can be stacked. That is, the pressure plate 14 constitutes a sheet material stacking unit to stack the sheet material P. The pressure plate 14 is selectively moved between a feeding position (for feeding the sheet material) where the sheet material P is fed and a standby position (for non-feeding the sheet material) where the sheet material P is not fed. The pressure plate 14 is rotatable within a predetermined range about a rotating shaft connected to the feeder base 22 and is urged against the feeding roller 16 by a pressure plate spring 26 (see FIG. 4). The pressure plate 14 is so constructed that it can be parted from the feeding roller 16 by a pressure plate release shaft 28. The switching of the position of the pressure plate 14 between the feeding position and the standby position is automatically executed by a switching drive unit including the pressure plate release shaft 28. The switching drive unit includes the pressure plate release shaft 28, a part of the control unit, a motor and a link mechanism and, by the driving or operation of these components, can change the position of the pressure plate 14.

The feeding roller 16 is included in a feeding means to feed the sheet material P. One feeding roller rubber 30 is provided at a center location of a feeding path of the sheet material P with respect to a longitudinal direction (rotational axis direction) of the feeding roller 16. This construction is taken in this embodiment because the sheet material P is positioned with its center as reference by the guide member 24. This feeding roller rubber 30 produces an enough grip force on the sheet material P to feed it.

The separation roller 18 is urged against the feeding roller 16. The separation roller 18 is provided to separate the sheet materials P one by one. The separation roller 18 is mounted to a separation roller holder 32. The separation roller 18 is rotatable about a rotating shaft provided on the feeder base 22. The separation roller 18 of the separation roller holder 32 is urged by a separation roller spring (not shown) to press against the feeding roller 16. The separation roller 18 is engaged with a clutch spring (not shown), which, when a load equal to or greater than a preset force is applied, allows the separation roller 18 to rotate. The separation roller 18 can be driven by a separation roller release shaft 34 and a controller cam (not shown) to engage or part from the feeding roller 16.

A return lever 20 to return the sheet material P to the stacking position on the pressure plate 14 is rotatably mounted on the feeder base 22 and urged toward a release direction by a return lever spring 36. In returning the sheet material P, the return lever 20 is rotated by a control cam.

The positions of these pressure plate 14, separation roller 18 and return lever 20 are detected by ASF sensors (not shown). According to the result of detection by using the ASF sensors as position detection means, the operation of the feeding roller 16, the control cam and others is controlled to properly execute the feeding and standby of the sheet material P.

As shown in FIG. 1, a feeding tray 38 to hold the stacked sheet material P can be mounted on the feeder base 22 or the enclosure. The feeding tray 38 is of a multi-stage structure and drawn out for use.

Now, how the sheet material P is fed by the feeding unit 12 will be explained. In a normal standby state, the pressure plate 14 is released from the feeding roller 16 by the pressure plate release shaft 28 and the separation roller 18 is also released from the feeding roller 16 by the controller cam. Further, the return lever in the normal standby state is located at a position where it pushes back the sheet material P and blocks a feed opening to prevent the stacked sheet material P from entering the opening.

When in this state the sheet material begins to be fed, the motor-driven control cam causes the separation roller 18 to engage the feeding roller 16. Then, the return lever 20 is displaced from the standby position, allowing the pressure plate 14 to engage the feeding roller 16. As a result, the pressure plate 14 that was held at the standby position is moved to the feeding position. In this state, the feeding of the sheet material P is started. The sheet material P is restricted by a front separation portion of the feeder base 22 so that only a predetermined number of sheet materials are carried to a nip portion configured by the feeding roller 16 and the separation roller 18. The carried sheet materials P are separated by the nip portion and only the uppermost sheet material P may be conveyed further.

When the sheet material P has reached a convey roller 40 and a pinch roller 42 of the conveying unit installed downstream in the feeding direction or conveying direction, the pressure plate 14 and the separation roller are disengaged from the feeding roller 16 by the pressure plate release shaft 28 and the controller cam, respectively. As a result, the pressure plate 14 is returned to the standby position. The return lever 20 is returned by the controller cam. At this time, the return lever 20 can push back the sheet material P that has reached the nip portion formed by the feeding roller 16 and the separation roller 18 to a predetermined position on the pressure plate 14.

The pressure plate 14 and the guide members 24 in the feeding unit 12 will be explained by referring the drawing, especially FIG. 5 to FIG. 8B. The guide members are movably mounted on the pressure plate 14 and are configured to be movable in a direction perpendicular to the feeding direction or conveying direction of the sheet material P.

The guide member 24 includes a restriction member 50 as a guide for the sheet material P as it is stacked and to prevent the sheet material P from tilting as it is fed, and a slider member 52. In this example two guide members 24 are provided here. They are both movably attached to the pressure plate 14. The guide member 24 is attached to the pressure plate 14 so as to nip the pressure plate 14 between the restriction member 50 and the slider member 52. Each of the restriction members 50 is movable relative to the pressure plate 14 so that the distance between the restriction members 50 can be adjusted according to the size of the sheet material P. To interlock the pair of restriction members 50 and allow for the adjustment of their positions, each of the slider members 52 is formed with a rack 54 that engages with a pinion 56 mounted on the pressure plate 14. The rack 54 and the pinion 56 are included in the drive unit of the guide members 24. The pinion 56 is mounted at the center of the back side of the pressure plate 14. The engagement between the pinion 56 and the pair of parallel racks 54 enables the left and right guide members 24 to be interlockingly adjusted in position.

Figure 6:
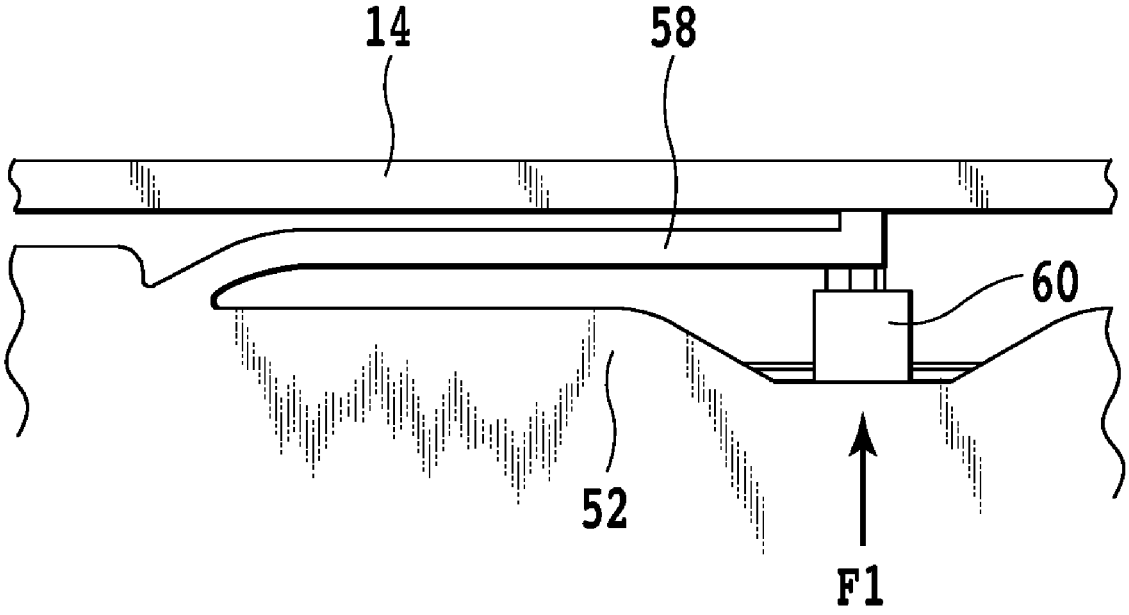
FIG. 6 is an enlarged schematic view of an area VI enclosed by a dashed line in FIG. 5.

The slider member 52, as shown in FIG. 6, has a friction arm 58 slidable against the pressure plate 14 and a friction spring 60 to produce an assisted bias force or increase the bias force by the friction arm 58 pushing the friction arm 58 against the pressure plate 14. The friction arm 58 slidable on the pressure plate 14 and the friction spring 60 together form a first holding force applying unit configured to apply a first holding force F1 for holding the guide members 24 to the pressure plate 14. The friction arm 58 is designed by taking its own elastic modulus and a friction coefficient with the pressure plate into consideration so as to produce the first holding force F1 of a desired magnitude. The spring force of the friction spring 60 is also designed to produce the first holding force of a desired magnitude. It is noted, however, that the friction spring 60 may not be provided, and for example, that the first holding force applying unit may be constructed only by the friction arm 58. The first holding force applying unit including the friction arm 58 and the friction spring 60 is provided for each of the guide members 24.

To increase a force required to rotate the pinion 56, there are provided a friction lever 62 slidably engageable with the pinion 56 and a friction spring 64 urging the friction lever 62 to press against the pinion 56. The friction lever 62 as an engagement member to engage the drive unit of the guide members 24 and the friction spring are provided so as to limit the movement of the drive unit of the guide members 24. The friction lever 62 and the friction spring 64 are mounted on a holding member 66 secured to the pressure plate 14. The friction lever 62 mounted on the holding member 66 is rotatable about a pin member 68 and movable from an engaged position where it engages the pinion 56 (see FIGS. 7A and 7B) to a disengaged position where it parts from the pinion 56 (see FIGS. 8A and 8B). The friction lever 62 is roughly T-shaped and has a body portion 70 extending straight from its rotation center held by the pin member 68, a protruding portion 72 projecting from the body portion 70 toward the pinion 56, and a spring receiving portion 74 receiving the friction spring 64. As can be seen from FIG. 5, FIGS. 7A and 7B and FIGS. 8A and 8B, the protruding portion 72 of the friction lever 62 is placed to come into contact with an outer circumference of a disk portion of the pinion 56, not a tooth part of the pinion 56. The friction lever 62 and friction spring 64 constitute a second holding force applying unit configured to apply a second holding force F2 to hold the guide members 24 to the pressure plate 14. The force required to rotate the friction lever 62 matches the second holding force F2 of a desired magnitude. The friction lever 62 itself and/or the spring force of the friction spring 64 are designed to produce the second holding force F2 of a desired magnitude. The second holding force applying unit including the friction lever 62 and the friction spring 64 is provided commonly for the two guide members 24. It is, however, possible to provide the second holding force applying unit to each of the guide members 24.

The pressure plate release shaft 28 has a release arm 76 for restricting the engagement of the friction lever 62 with the pinion 56. The release arm 76 is kept out of contact with the back of the pressure plate and extends in a direction substantially perpendicular to the longitudinal direction of the pressure plate release shaft 28 that extends substantially parallel to the pressure plate 14. The release arm 76, when the pressure plate 14 is in the standby position, engages a surface 78 of the body portion 70 of the friction lever 62 to push the friction lever 62 away from the pinion 56. The surface 78 engages the release arm 76 to cause the friction lever 62 to rotate and therefore can be called a rotational operation aiding surface. The surface 78 is an inclined surface and is formed so as to aid the engagement between the release arm 76 and the friction lever 62. Here, they are constructed so that the engagement of the release arm 76 with the friction lever 62 causes the pinion 56 and the friction lever 62 to completely part from each other (see FIGS. 8A and 8B). However, the pinion 56 and the friction lever 62 do not have to be completely separated when the release arm 76 engages the friction lever 62. That is, the engagement between the release arm 76 and the friction lever 62 needs only to be restricted to weaken the contact between the pinion 56 and the friction lever 62. The release arm 76 constitutes a restraining unit which, when the pressure plate 14 is in the standby position, restrains the friction lever 62 from applying its force to the pinion 56. In this embodiment, the release arm 76 acts to completely prevent or prohibit the application of the friction lever force.

Figure 8A:
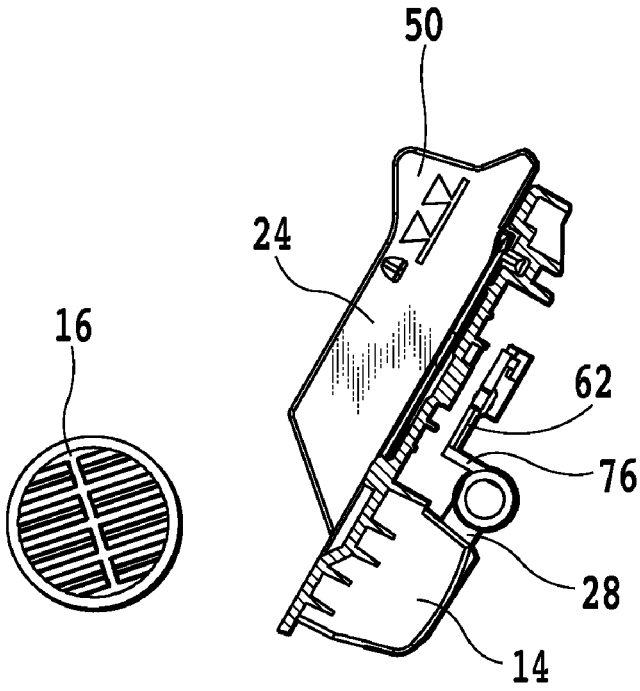
FIGS. 8A and 8B are a side cross-sectional view and a back view showing main members of the feeding unit at a standby position during a pressure plate standby.
Figure 8B:
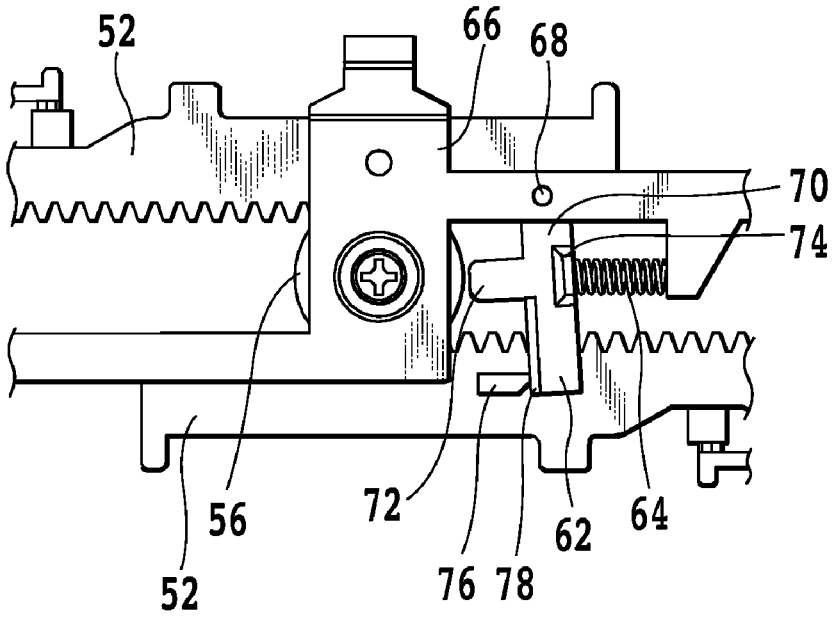

As described above, when the pressure plate 14 is in the standby position, the engagement of the friction lever 62 with the pinion 56 is restricted (see FIGS. 8A and 8B). At this time, practically only the first holding force F1 produced by the friction arm 58 and the friction spring 60 is positively applied between the guide members and the pressure plate 14. Therefore, the force required to move the guide members 24 at this moment is not large, so that the distance between the paired restriction members 50 can be adjusted easily. However, the first holding force F1 is large enough to position and hold the guide members 24 on the pressure plate 14 so long as a force equal to or greater than a predetermined level (or a first predetermined force) is not applied to the guide members 24. Therefore, the guide members 24 positioned according to the size of the sheet material P are properly held on the pressure plate 14 when the pressure plate 14 is in the standby position.

Figure 7A:
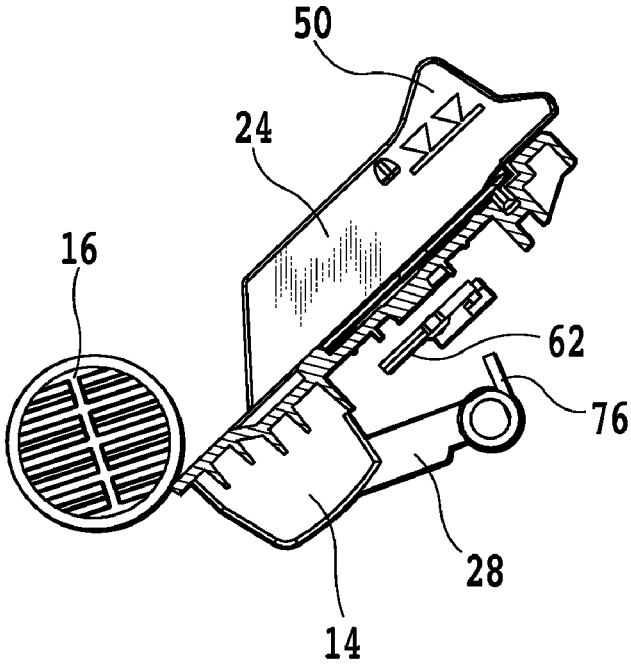
FIGS. 7A and 7B are a side cross-sectional view and a back view showing main members of the feeding unit at a feeding position during a feeding operation.
Figure 7B:
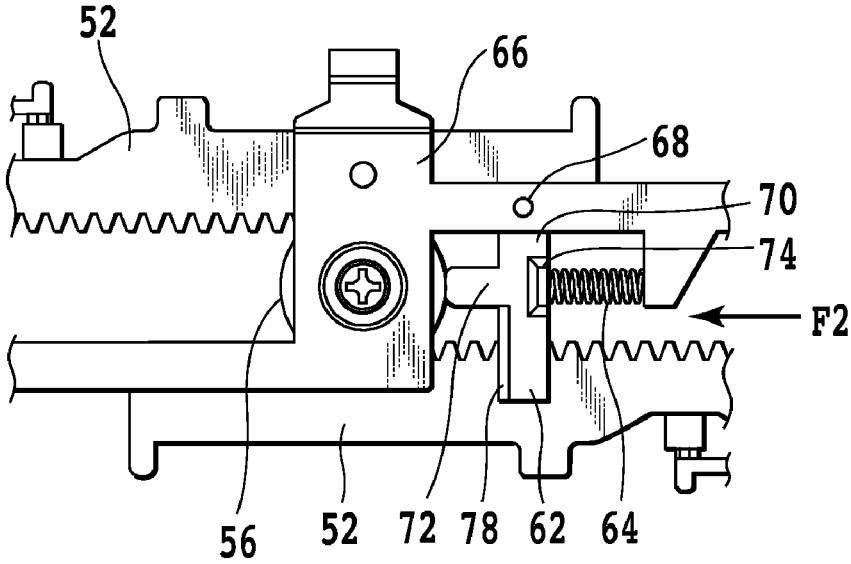

When, on the other hand, the pressure plate 14 is in the feeding position, the engagement of the friction lever 62 with the pinion 56 occurs (see FIGS. 7A and 7B). At this time, in addition to the first holding force F1, the second holding force F2 produced by the friction lever 62 and the friction spring 64 is positively applied between the guide members 24 and the pressure plate 14. Therefore, the force required to move the guide members 24 can be made equal to or greater than a second predetermined force, preventing the guide members 24 from being moved inadvertently by the feeding operation of the sheet material P or the like. As a result, the sheet material P can be properly restricted, guided and aligned in a desired direction during feeding operation of the sheet material P.

In the above embodiment, the sheet feeding apparatus installed in an inkjet printing apparatus has been described. It should be noted, however, that the sheet material feeding apparatus according to the present invention can also be used in a variety of image forming apparatuses, such as printers of wire dot type, thermal type and electrophotographic type, copying machines and facsimiles, and in other apparatuses that require a sheet material feeding operation.

While in the above embodiment the sheet material feeding apparatus has been described to have two movable guide members, one of the guide members may be fixed, with the other made movable. In this case, too, the first holding force applying unit, the second holding force applying unit and the restraining unit, similar to those of the above embodiment, may be provided to the movable guide member.

Further, the first holding force applying unit is not limited to the construction described above and may adopt a different one. The second holding force applying unit is also not limited to the above construction and may adopt any other desired one. Further, the restraining unit is not limited to the above construction and may adopt any other desired one.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-275551, filed Dec. 3, 2009, which is hereby incorporated by reference herein in its entirety.

What is claimed is:

1. A sheet material feeding apparatus comprising:

a sheet material stacking unit located selectively at a feeding position for feeding a sheet material and at a standby position for non-feeding a sheet material and on which one or more sheet materials are stacked;

a guide member mounted to the sheet material stacking unit to restrict the position and direction of the sheet material, the guide member being slidable on the sheet material stacking unit in a direction perpendicular to a sheet material feeding direction;

a first holding force applying unit configured to apply a first holding force for holding the guide member to the sheet material stacking unit;

a second holding force applying unit configured to apply a second holding force for holding the guide member to the sheet material stacking unit; and a restraining unit configured to restrain the second holding force applying unit from applying the second holding force when the sheet material stacking unit is in the standby position.

2. A sheet material feeding apparatus according to claim 1, wherein the restraining unit prohibits the application of the second holding force by the second holding force applying unit when the sheet material stacking unit is in the standby position.

3. A sheet material feeding apparatus according to claim 1, wherein the first holding force applying unit is provided to the guide member and has a member slidable on the sheet material stacking unit.

4. A sheet material feeding apparatus according to claim 1, wherein the second holding force applying unit has an engagement member which, when the sheet material stacking unit is in the feeding position, engages a drive unit of the guide member to limit the movement of the guide member.

5. A sheet material feeding apparatus according to claim 4, wherein the restraining means has a member which, when the sheet material stacking unit is in the standby position, restrains the engagement member from engaging the drive unit.

6. An image forming apparatus having the sheet material feeding apparatus of claim 1.

* * * * *